United States Patent [19]

Myers

[11] Patent Number: 4,942,995

[45] Date of Patent: Jul. 24, 1990

[54] CAR RADIO HOLSTER

[76] Inventor: Errol Myers, 190 Palmetto St., Brooklyn, N.Y. 11221

[21] Appl. No.: 401,042

[22] Filed: Aug. 31, 1989

[51] Int. Cl.[5] ..... A45F 3/14

[52] U.S. Cl. ..... 224/258; 224/257; 224/264; 455/346; 455/351; 294/170; 294/149

[58] Field of Search ..... 224/257, 258, 264, 271, 224/272, 202; 455/345, 346, 348, 351; 307/10 AT; 16/114 R, 126; 294/170, 149, 139

[56] References Cited

U.S. PATENT DOCUMENTS

| | | | |
|---|---|---|---|
| 2,638,041 | 5/1953 | Horydczak | 16/114 R |
| 3,916,122 | 10/1975 | Sato et al. | 455/348 |
| 4,081,850 | 3/1978 | Walden | 360/93 |
| 4,401,246 | 8/1983 | Dickinson et al. | 224/258 |
| 4,440,334 | 4/1984 | Kappel et al. | 224/258 |

FOREIGN PATENT DOCUMENTS

| | | | |
|---|---|---|---|
| 2176 | of 1902 | United Kingdom | 294/170 |

*Primary Examiner*—Linda J. Sholl
*Attorney, Agent, or Firm*—Iman Ahdallah

[57] ABSTRACT

A shoulder holster carrying device for a removable vehicle radio. The device includes a frame member which fits about the periphery of the forepart of the radio and a shoulder strap which is selectively attachable to the frame member.

3 Claims, 1 Drawing Sheet

CAR RADIO HOLSTER

BACKGROUND OF THE INVENTION

The present invention generally relates to removable vehicle radios. In particular this invention relates to carrying means for a removed vehicle radio.

The proliferation of radio theft from automobiles, trucks and the like has caused many owners to install retractable radio support frames, some models known commercially as "Benzi Boxes." "Benzi Boxes" permit the owner to remove the radio from the dashboard of a vehicle without disassembly of the radio and place it either under the seat or in the trunk of the vehicle. Alternatively, radios fastened to "Benzi Boxes" may be completely moved away from the vehicle and carried with the owner when (s)he leaves the vehicle parked. While shopping and the like carrying the radio by hand can be difficult and cumbersome.

SUMMARY OF THE INVENTION

The present invention provides carrying means for a vehicle radio that is disposed within a retractable radio support frame. The carrying device comprises a frame member, which fits about the periphery of the forepart of the radio, and a shoulder strap which is selectively attachable to said frame member and thereby permits the removed radio to be carried over the shoulder or arm of the owner.

An object of the present invention is to provide convenient means for carrying a vehicle radio that is disposed within a retractable support frame.

Another object of this invention is to provide a carrying device for a removable vehicle radio that is simple and inexpensive to manufacture.

These and other objects of the present invention will be apparent to those skilled in the art from the following drawings, description of a preferred embodiment and claims.

DESCRIPTION OF THE PREFERRED EMBODIMENT

Figure 1:
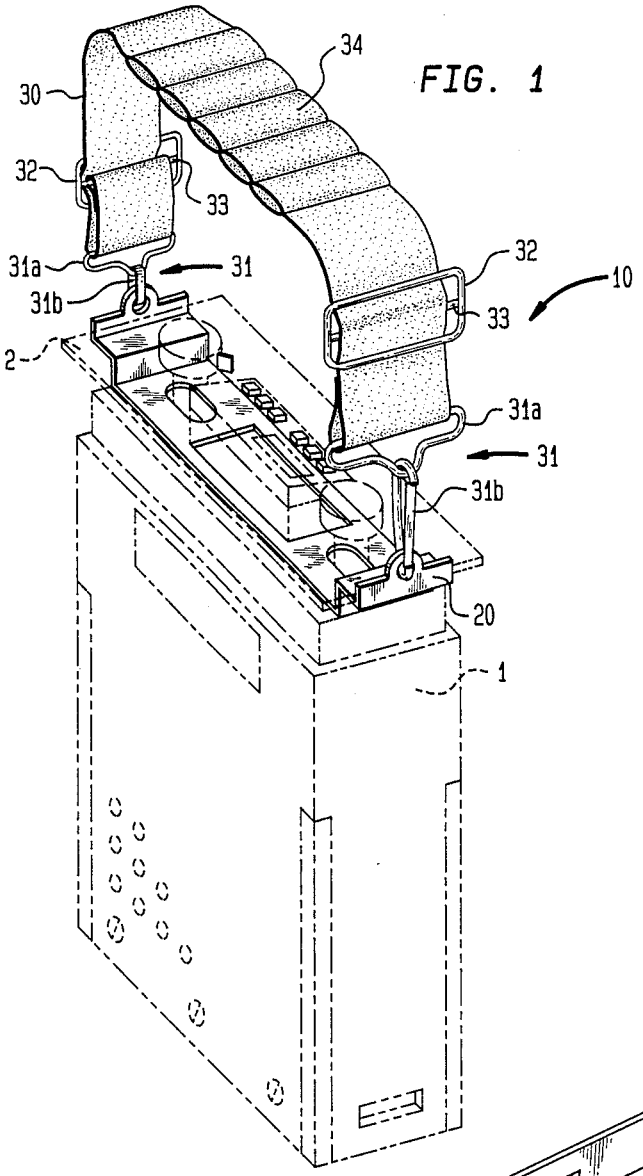
FIG. 1 is a perspective view of the present invention shown attached to a vehicle radio that is fastened to a retractable radio support frame.

FIG. 1 illustrates in a perspective view the carrying device 10 of the present invention shown attached to a vehicle radio 1. The radio 1 as shown by the faded lines is disposed within a "Benzi Box" retractable support frame. Carrying device 10 includes a frame member 20 and shoulder strap 30. Frame member 20 fits adjacent to the main body of said radio 1 below the radio cover 2 and is secured thereto as hereinafter described in greater detail.

Shoulder strap 30 is substantially an elongated belt having hook attachments 31 disposed at each end thereof. Hook attachments 31 provide means for selective attachment of said shoulder strap 30 to said frame 20. Each hook attachment 31 comprises a hook support member 31*a* and a hook clip 31*b*. Hook support member 31*a* is disposed within a loop of the strap 30 formed proximate to the end portion of said strap 30. Hook clip 31*b* fits about said hook support member 31*a* and attaches to said frame 20. Shoulder strap 30 further includes strap length adjustment means comprising a rectangular slide 32 formed as a rectangular frame member having a tongue 33 extending across the mid-portion of said frame member. Shoulder strap 30 extends through slide 32 passing to one side of the top and bottom portions of said slide 32 and across the opposite side of said tongue 33. The end of said shoulder strap 30 is fixedly attached to the tongue 33 of said slide 32 thereby forming a loop below said slide 32 through which said hook support member 31*a* attaches to said shoulder strap 30. This arrangement permits slide 32 to be manually adjusted to alter the length of said strap 30. Shoulder strap 30 also includes strap padding 34 disposed at the central portion of said strap 30 to facilitate relief of shoulder discomfort when the radio 1 is carried.

Figure 2:
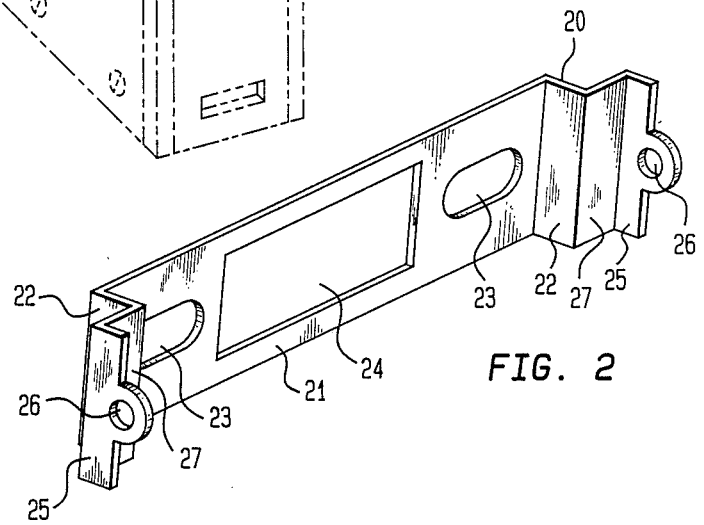
FIG. 2 is a perspective view of the frame member of the present invention.

Referring now to FIG. 2 the frame member 20 can be seen in greater detail. Frame 20 is a substantially C-shaped member, preferably formed from forged steel, having a main body portion 21 and reversed-Z-shaped arms 22 extending from each end of said main body 21. Frame arms 22 have openings 26 formed in the distal leg 25 of said Z-shaped member providing means for attachment of the clips 31*b* of said hook attachments 31. When the frame member 20 is fitted about the periphery of said radio 1, the cover 2 of said radio 1 (FIG. 1) rests on the central portion 27 of the arms 22 of said frame member 20. The main body 21 of said frame member 20 includes a centrally disposed rectangular opening 24 for receipt of the face of said radio 1 and elliptical openings 23 formed to each side of said rectangular opening 24 for receipt of the knob spindles of said radio 1. Frame member 20 may also be formed to include top and bottom plates (not shown) which fit across frame member 20 for the width of said main body 21.

"Benzi Boxes" are attached to a radio 1 by means of nuts (not shown) which attach about the knob spindles of the radio 1. In the preferred embodiment these same nuts are used to secure the frame member 20 to the radio 1. Frame member 20 is placed below the cover 2 and the "Benzi Box" nuts are attached about the knob spindles between the frame member 20 and the cover 2. With frame member 20 constructed in the manner previously described and so attached by the nuts included with said "Benzi Boxes" the frame member 20 is thereby fixedly connected to said radio 1 in a manner which does not interfere with the removal and replacement of said radio 1 within the dashboard of the vehicle. When the radio 1 is removed, the shoulder strap 30 is simply attached and the radio 1 is carried away by the owner.

Therefore in view of the foregoing I claim:

1. A device for carrying a vehicle radio comprising a frame member fixedly attachable to said radio, and a shoulder strap selectively attachable to said frame member, said frame member being formed in a manner to be fitted about the periphery of the forepart of said radio, said frame member comprising a substantially C-shaped member including a main body portion and reversed-Z-shaped arms extending from each end of said main body portion, said main body portion including a centrally disposed rectangular opening for receipt of the face of said radio and elliptical openings formed to each side of said rectangular opening for receipt of the knob spindles of said radio, said arms having openings formed in the distal leg of said Z-shaped member providing means for attachment of said shoulder strap.

2. A device for carrying a vehicle radio comprising a frame member fixedly attachable to said radio, said frame member being formed in a manner to be fitted about the periphery of the forepart of said radio and comprising a substantially C-shaped member including a main body portion and reversed-Z-shaped arms extending from each end of said main body portion, said main body portion including a centrally disposed rectangular opening for receipt of the face of said radio and elliptical openings formed to each side of said rectangular opening for receipt of the knob spindles of said radio, said arms having openings formed in the distal leg of said Z-shaped member providing means for attachment of said shoulder strap, and a shoulder strap selectively attachable to said frame member, said shoulder strap comprising an elongated belt having hook attachments disposed at each end of said belt, said hook attachments providing means for selective attachment of said shoulder strap to said frame member, each hook attachment comprising a hook support member and a hook clip, said hook support member being disposed within a loop formed proximate to the end portion of said strap, said hook clip fitting about said hook support member being attachable to said frame member, said shoulder strap further including strap length adjustment means, said strap length adjustment means comprising a rectangular slide formed as a rectangular frame member having a tongue extending across the mid-portion of said frame member, said shoulder strap extending through said slide by passing to one side of the top and bottom portions of said frame member and across the opposite side of said tongue, the end of said shoulder strap being fixedly attached to the tongue of said slide thereby forming a loop below said slide through which said hook support member attaches to said should strap.

3. A carrying device as described in claim 2 wherein said shoulder strap includes strap padding disposed at the central portion of said strap.

* * * * *